United States Patent [19]

Guimarin

[11] Patent Number: 5,017,746

[45] Date of Patent: May 21, 1991

[54] LOW COST LIGHT SWITCH EXTENSION ARM

[76] Inventor: Henry L. Guimarin, 375 Palm Springs Dr., Apt. 1122, Altamonte Springs, Fla. 32701

[21] Appl. No.: 486,412

[22] Filed: Feb. 28, 1990

[51] Int. Cl.[5] ..... H01H 3/46

[52] U.S. Cl. ..... 200/331

[58] Field of Search ..... 200/331

[56] References Cited

U.S. PATENT DOCUMENTS

| | | | |
|---|---|---|---|
| 574,247 | 12/1896 | Jepson | 200/331 |
| 2,668,456 | 2/1954 | Meistrell | 200/331 |
| 3,077,789 | 2/1963 | Lashmutt | 200/331 |
| 3,175,420 | 3/1965 | Craig | 200/331 |
| 3,339,051 | 8/1967 | De Vall | 200/331 |
| 3,916,134 | 10/1975 | Hansen | 200/331 |

*Primary Examiner*—Renee S. Luebke

*Attorney, Agent, or Firm*—Julian C. Renfro

[57] ABSTRACT

An extension device of unitary, non-metallic construction for use by a small person in operating an electric toggle switch utilizing a spaced pair of screws for securing the switch plate to the outer portion of the toggle switch. This device comprises an arm of elongate, relatively rigid construction having a handle at one end, and a switch-contacting member at the other end. The switch-contacting member has a hole therein insertable over the lever component of the toggle switch, with a slot in the switch-contacting member closely adjacent the hole. A strap member is utilized for holding captive the switch-contacting member of the arm to the switch plate of the toggle switch. This strap member has a screw-accommodating hole adjacent each end and because of its length, being caused to extend in a somewhat bowed out configuration across the front of the switch when the hole in the switch-contacting member has been placed over the lever component, and each end of the strap member has been secured to the switch plate. The slot in the switch-contacting member permits unrestrained motion of the arm with respect to one of the screws.

6 Claims, 1 Drawing Sheet

LOW COST LIGHT SWITCH EXTENSION ARM

FIELD OF THE INVENTION

This invention relates to an extension arm for a wall mounted toggle switch, and, more particularly, it relates to an extension arm which permits a child to have access to the wall mounted switch, by means of a control member hanging from the switch to be within the reach of the child.

DISCLOSURE DOCUMENT PROGRAM

A Disclosure of this invention was filed in accordance with the Disclosure Document Program, and it was accorded No. 239,835.

BACKGROUND OF THE INVENTION

The present invention relates to a light switch extension arm of non-metallic construction, that is generally comprised of a lever arm adapted to be readily attached to the switch actuating toggle portion of a standard wall switch used for turning on and off the lights of a room. My extension arm is particularly helpful to small children that are not tall enough to reach a normally positioned conventional light switch, in order to turn on and off a light.

As is well known, a light switch is typically positioned on a wall at a height convenient for adults, with little attention being directed to the problem encountered by a child old enough to go to the bathroom, or to the kitchen for a drink of water at night, but not tall enough to actuate the light switch without the aid of a stool, chair, or the like. Realizing this problem, many parents leave a light burning all night so as to provide a means by which small children may have adequate illumination to find their way about the home at night, without disturbing their parents. Such operation of a light all night, every night, is expensive since it consumes a substantial amount of electricity over a period of time. Additionally, a light left on all night often becomes distracting, and may even attract unwanted guests.

A number of others have addressed this problem, and for example, the Craig U.S. Pat. No. 3,175,420 entitled "Extension Device for Toggle Switches" teaches the use of an elongate arm of rigid construction, but his device requires the use of a pivotally mounted member on the end opposite the handle of the device, and the use of the pivotally mounted member necessarily drives up the cost of the Craig device, making the purchase thereof in a class with luxury items.

Somewhat similarly, the De Vall U.S. Pat. No. 3,339,051 entitled "Light Switch Extension Arm" reveals a device utilizing metallic members, which not only makes it relatively expensive, but also might potentially provide a shock hazard.

Furthermore, the Hansen U.S. Pat. No. 3,916,134 entitled "Extension Control for a Wall Mounted Toggle Switch" sets forth the use of an elongate arm utilizing a shaped wire involving a loop at each end, with one of the loops to engage the finger operated lever of the toggle switch, but here again is not only the expense, but also the potential danger of a shock to a young child or even an adult confined to a wheel chair.

In addition to obviating the foregoing objections, the present novel device enables self reliance and independence to be taught to children by allowing them to provide for themselves so far as concerns going to the bathroom and turning on their own lights, unassisted by their parents, for the parents can rest assured that their children will not be injured. Furthermore, the present novel device helps to eliminate much of the inborn and hereditary fear of darkness to which we all are subject.

SUMMARY OF THE INVENTION

The present novel device is adapted to be readily attached, or detached, to any standard light switch without disturbing any of the wiring or the switch mechanism itself. My device is of low cost, is non-metallic and harmless to the user, and in no way is detrimental from a standpoint of safety. This extension arm may be readily attached or detached with a minimum of time and with a mere trifle of effort. Moreover, the device is simple in operation, inexpensive to purchase and maintain, rugged in construction, and attractive in appearance. Just above the handle I may prefer to use an attractive design, that may advantageously be coated with luminous paint that glows in the dark, so as to enable one to easily find it in the darkness.

In the device herein disclosed, the light switch extension arm may be secured directly to the movable switch portion of a standard domestic light switch by a small strap, to assure that the arm will be available when needed to actuate the switch from a location closer to the floor.

Considering this device now in more detail, my extension device is to be seen to be of unitary, non-metallic construction for use by a small person in operating an electric toggle switch of the type utilizing a spaced pair of screws for securing the switch plate to the outer or front portion of the toggle switch. I utilize an arm of elongate, relatively rigid construction having a handle at one end, and a switch-contacting member at the other end. The switch-contacting member has a hole therein of a size enabling it to be readily inserted over the lever component of the toggle switch normally contacted by the finger of the user. A slot is provided in the switch-contacting member closely adjacent the hole.

A strap member is utilized for holding captive the switch-contacting member of the arm to the switch plate of the toggle switch, with this strap member being of a length somewhat greater than the distance between the pair of screws normally utilized to hold the switch plate in place on the toggle switch. For readily understood reasons, the strap has a screw-accommodating hole adjacent each end, and because of its length, the strap is caused to extend in a somewhat bowed out configuration across the front of the switch at such time as the hole in the switch-contacting member has been placed over the lever component, and each end of the strap member has been secured to the switch plate by one of the screws. The bowing out of the strap provides clearance for motion of the lever component, and the slot in the switch-contacting member permits unrestrained motion of the arm with respect to one of the screws. Advantageously, an attractive design may be placed on the arm just above the handle, and coated with luminous paint, making it readily possible to find the handle in the dark.

The primary object of my invention is therefore to provide a low cost switch arm extension means of non-metallic construction that may be readily attached to a standard domestic light switch, without any tool other than a small screwdriver being needed.

Another object of this invention is to provide an elongate switch arm of minimal expense, that may be readily attached to a standard light switch so as to enable small children to turn on or off the light switch in a convenient and logical manner.

Still a further object of this invention is to provide a switch arm extension means that may be readily and efficiently attached to an existing light switch by a short strap that serves to protect the arm against displacement or loss.

A yet further object of this invention is the provision of a light switch extension arm that is attractive in appearance, rugged in construction, simple in design, and is provided with a bowed out strap used to hold the arm in place without in any way interfering with motion of the switch by the user.

DETAILED DESCRIPTION

Figure 1:
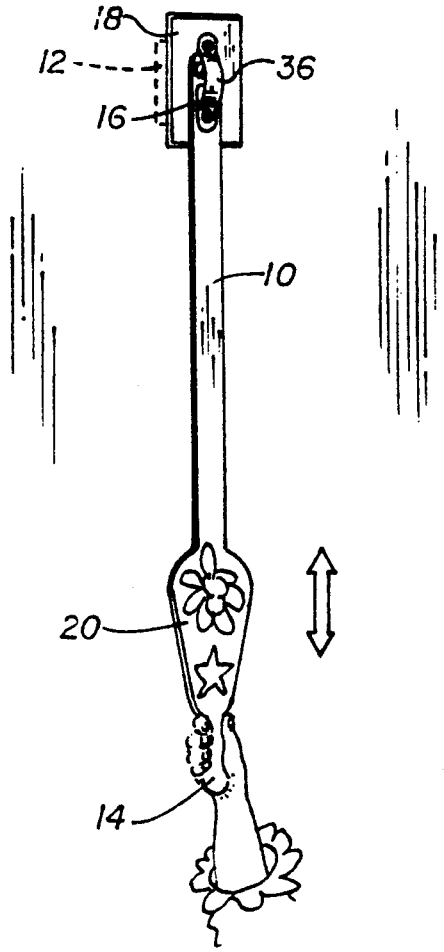
FIG. 1 is a view showing my novel extension arm in a functional position, attached to a typical wall mounted toggle switch, with the length of the arm being sufficient to place the handle of my device in easy reach of a small person.

With reference to FIG. 1 it will there be seen that I have provided an extension device 10 of unitary, non-metallic construction for use by a small person, in operating a conventional electric toggle switch 12. Such a toggle switch is customarily used on the wall of a room for turning on or off the lights, and the outline of such a switch is revealed in FIG. 3. The device 10 may also be regarded as an elongate arm having a handle 14 at one end, and a switch-contacting member 16 at the other end.

Figure 2:
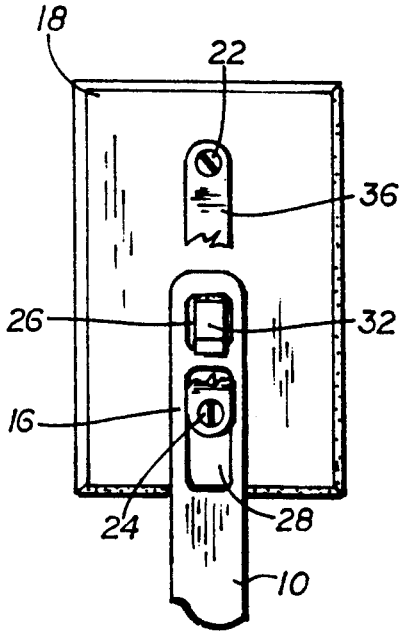
FIG. 2 is a view to a larger scale of the toggle switch, with the retention strap broken away to reveal how the switch contacting end of my extension arm is attached to the finger operated lever of the wall switch.
Figure 2A:
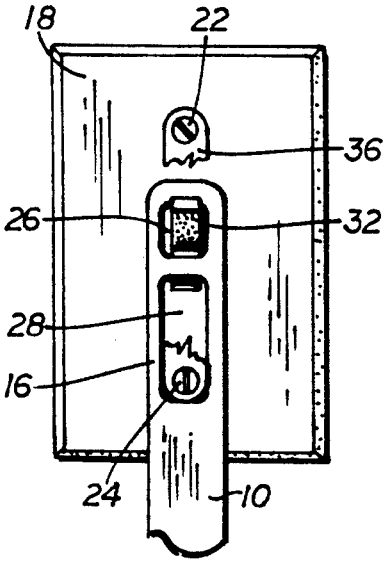
FIG. 2*a* is a view closely resembling FIG. 2, but showing the finger operated lever of the wall switch having been moved upward to the "on" position by the user having pushed upwardly on the extension arm.
Figure 3:
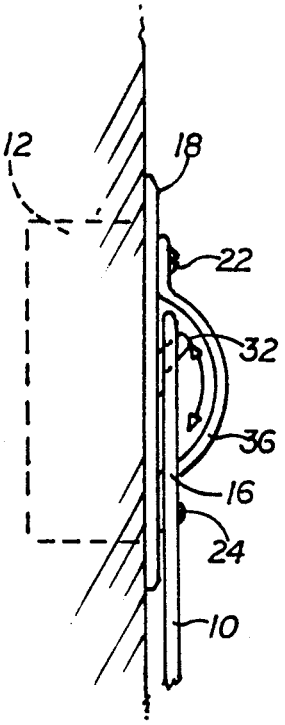
FIG. 3 is a side view revealing by the use of phantom lines, the typical relationship of the body of the toggle switch to the upper end of my extension arm, with this view also revealing the use of the retention strap utilized to prevent loss or displacement of the extension arm from the switch.

As depicted in FIG. 1, but shown in greater detail in FIGS. 2, 2*a* and 3, the conventional toggle switch 12 is normally covered by the customary switch plate or cover plate 18, which is held in place by a spaced pair of screws 22 and 24.

As revealed in FIGS. 2 and 2*a*, a portion of the switch-contacting member 16 is configured to be of a size to fit, with a suitably small amount of clearance, over the lever component 32 of the toggle switch 12, the lever component 32 being the portion of the switch normally contacted by the finger of the user. As will be understood, in FIG. 2 I reveal the arm 10 in its downward position, in which the lever component 32 is in the "off" position, whereas in FIG. 2*a* I show the arm having been moved to its upward position, in which the lever component 32 is in the "on" position. It is to be noted that the configured portion of the switch contacting member may be a hole 26, alongside which is an elongate hole or slot 28 provided for a purpose soon to become apparent.

The elongate arm 10 is loosely held captive over the toggle switch by the use of a semi-rigid strap member 36, which is provided with a small hole adjacent each end. Each of such small holes is of a size large enough to receive the threaded portion of the screws 22 and 24, but being too small for the head of screw 22 or 24 to pass through. I deliberately cause the length of the strap member 36 to be somewhat greater than the distance between the screws 22 and 24. Thus, when held in place on the switch plate 18 by the pair of screws, the strap member 36 is caused to bow out to some extent, as revealed in FIGS. 1 and 3, so as to avoid contact with the lever component 32 of the toggle switch, as the lever component is moved between the switch-off and the switch-on positions. The clearance between the inner surface of the strap member and the outer end of the lever component 32 is sufficiently small as to prevent undesired displacement of the switch-contacting member from the lever component 32. As is obvious, I am not to be limited to the use of a strap member, for I can use a bowed out member of plastic or the like that has a permanent, curved configuration.

It is because of the use of the member 36 that the elongate arm 10 in accordance with this invention is held captive upon the switch plate 18, and because of the way I go about securing the strap member 36 to the switch, it is necessary to provide the aforementioned slot 28 in the end of the arm remote from the handle 14. This slot makes possible the relationship of the strap member 36 to the lower screw 24 to be such as not to interfere with motion of the arm 10 between the switch-on and switch-off positions.

As best revealed in FIGS. 2 and 2*a*, the slot 28 should be sized so as to provide sufficient clearance with respect to the lower screw 24 when the lever component 32 of the switch has been moved to the switch-on or upper position of its motion. As is clearly obvious from FIG. 3, the desired relationship between the lever component 32 of the toggle switch, and the upper hole 26 of the switch-contacting member 16 is assured by the use of the bowed out strap member 36.

My device is thus to be seen to be of low cost, non-metallic construction, and by way of example, the arm 10 can be of relatively rigid plastic as will readily enable the user to provide an upward push to the lever component 32 of the toggle switch 12 when the small person grasps the handle 14 as shown in FIG. 1, and pushes upwardly on the arm.

My novel device has proven to be of help to persons other than children, such as those confined to wheelchairs.

Because the arm 10 is of non-conductive plastic, no possible shock hazard to the child is involved. I prefer to provide an attractive design 20 just above the handle 14, which may be of luminous material that glows in the dark.

My invention may take other forms, and I am not to be limited to the illustrated construction except as required by the scope of the appended claims.

I claim:

1. An extension device of non-metallic construction for use by a small person in operating an electric toggle switch having a front portion upon which is located a switch plate, and an operating lever protruding therethrough, which switch plate is held in position by a spaced pair of screws, said device comprising an arm of elongate, relatively rigid construction having a handle at one end, and a switch-contacting member at the other end, a portion of said switch-contacting member being configured to be inserted over the operating lever of the toggle switch, a slot in said switch-contacting member closely adjacent said configured portion, and an outwardly curved member for holding captive said switch-contacting member of said arm to the toggle switch, said curved member having a screw-accommodating hole adjacent each end and because of its curvature, being caused to extend across the switch at such time as the configured portion of said switch-contacting member has been placed over the operating lever, and each end of said curved member has been secured to the switch plate by a respective one of the screws, the curvature of said curved member providing clearance for motion of the lever component resulting from arm movements, and said slot in said switch-contacting member permitting motion of said arm with respect to one of the aforementioned screws.

2. An extension device as recited in claim 1 in which an attractive design is placed on said arm just above said handle.

3. An extension device as recited in claim 2 in which at least a portion of said arm is coated with luminous material.

4. An extension device of non-metallic construction for use by a small person in operating an electric toggle switch having a front portion upon which is located a switch plate, and an operating lever protruding therethrough, which switch plate is held in position by a spaced pair of screws, said device comprising an arm of elongate, relatively rigid construction having a handle at one end, and a switch-contacting member at the other end, said switch-contacting member having a hole therein to be inserted over the operating lever of the toggle switch, a slot in said switch-contacting member closely adjacent said hole, and a strap member for holding captive said switch-contacting member of the arm to the switch plate of the toggle switch, said strap member being of a length somewhat greater than the distance between the pair of screws normally utilized to hold the switch plate in place on the toggle switch, said strap member having a screw-accommodating hole adjacent each end and because of its length, being caused to extend in a somewhat bowed out configuration across the front of the switch at such time as the hole in said switch-contacting member has been placed over the lever component, and each end of said strap member has been secured to the switch plate by one of the screws, the bowing out of said strap member providing clearance for motion of the lever component, as the lever component is moved by said arm between switch-on and switch-off positions, and said slot in said switch-contacting member permitting motion of said arm with respect to one of the aforementioned screws.

5. An extension device as recited in claim 4, in which an attractive design is placed on said arm just above said handle.

6. An extension device as recited in claim 5 in which at least a portion of said arm is coated with luminous material.

* * * * *